US012491399B2

(12) United States Patent
Sun

(10) Patent No.: US 12,491,399 B2
(45) Date of Patent: Dec. 9, 2025

(54) RESISTANCE PULLEY STRUCTURE, ROWING MACHINE, AND ROWING HIGH-POSITION PULL-DOWN INTEGRATED MACHINE

(71) Applicant: Sunny Distributor Inc., City of Industry, CA (US)

(72) Inventor: Yu Sun, City of Industry, CA (US)

(73) Assignee: Sunny Distributor Inc., City of Industry, CA (US)

( * ) Notice: Subject to any disclaimer, the term of this patent is extended or adjusted under 35 U.S.C. 154(b) by 141 days.

(21) Appl. No.: 18/120,444

(22) Filed: Mar. 13, 2023

(65) Prior Publication Data

US 2024/0189652 A1 Jun. 13, 2024

(30) Foreign Application Priority Data

Dec. 9, 2022 (CN) ..... 202211580829.4
Dec. 9, 2022 (CN) ..... 202223315177.X
Dec. 9, 2022 (CN) ..... 202223316128.8

(51) Int. Cl.
*A63B 21/00* (2006.01)
*A63B 22/00* (2006.01)

(52) U.S. Cl.
CPC ..... *A63B 21/154* (2013.01); *A63B 21/00069* (2013.01); *A63B 21/00192* (2013.01); *A63B 22/0076* (2013.01); *A63B 2022/0079* (2013.01)

(58) Field of Classification Search
CPC ..... A63B 21/00069; A63B 21/00192; A63B 2022/0079; A63B 2022/0035; A63B 21/153; A63B 21/157; A63B 21/225; A63B 22/0087; A63B 21/0051; A63B 21/151; A63B 21/154–156; A63B 22/0076–0089
See application file for complete search history.

(56) References Cited

U.S. PATENT DOCUMENTS

| | | | | |
|---|---|---|---|---|
| 2012/0100965 | A1* | 4/2012 | Dreissigacker | A63B 22/0005 482/72 |
| 2014/0243163 | A1* | 8/2014 | Edmondson | A63B 21/227 482/72 |
| 2016/0375297 | A1* | 12/2016 | Kiser | A63B 69/06 482/73 |
| 2017/0319941 | A1* | 11/2017 | Smith | A63B 24/0003 |
| 2018/0169463 | A1* | 6/2018 | Ellis | A63B 23/03575 |
| 2018/0214734 | A1* | 8/2018 | Lammers | A63B 21/225 |
| 2018/0272182 | A1* | 9/2018 | Hou | A63B 22/0076 |
| 2019/0054343 | A1* | 2/2019 | Chiang | A63B 21/0435 |
| 2020/0155889 | A1* | 5/2020 | Leipheimer | A63B 21/156 |
| 2024/0082625 | A1* | 3/2024 | Hsu | A63B 21/0442 |

* cited by examiner

*Primary Examiner* — Megan Anderson
*Assistant Examiner* — Catrina A Letterman

(57) ABSTRACT

A resistance pulley structure includes a symmetrical stay cord assembly, a transmission assembly, a resistance assembly and driving parts. The stay cord assembly includes a stay cord, a first and a second fixed pulley block and a movable pulley block. The movable pulley block includes a left and right movable pulleys, and the second fixed pulley block includes a second left fixed pulley and a second right fixed pulley. The rotation direction of the second fixed pulley block is parallel to the rotation direction of the first fixed pulley. After the stay cord bypasses the first fixed pulley, two ends bypass the left and right movable pulley respectively, then bypass the second left fixed pulley and the second right fixed pulley respectively, and connected to the driving parts.

8 Claims, 9 Drawing Sheets

RESISTANCE PULLEY STRUCTURE, ROWING MACHINE, AND ROWING HIGH-POSITION PULL-DOWN INTEGRATED MACHINE

TECHNICAL FIELD

The present disclosure relates to the technical field of resistance components, in particular to a resistance pulley structure, a rowing machine, and a rowing high-position pull-down integrated machine applied thereto.

BACKGROUND

The resistance component is a mechanism that provides resistance to movement and consumes movement energy. In aerospace, aviation, military industry, guns, automobiles and other industries, various resistance components have been used to reduce vibration and energy. Resistance components are also used in many equipment in daily life and production and processing, such as tensioners and rowing machines in the field of fitness equipment. The most common resistance component is the stay cord tension mechanism. The existing stay cord mechanism usually forms resistance through the cooperation of a single stay cord and a fixed pulley. The user overcomes the resistance of the stay cord to pull it. This structure is basically a single-direction operation method, the tensile strength of the single cord is low and the stress is uneven.

SUMMARY

The present disclosure is intended to provide a resistance pulley structure, which is convenient to bear force, has high stability, and can adjust the strength of the pulling force.

In order to achieve the above object, the solution of the present disclosure is: a resistance pulley structure, comprising symmetrical stay cord assemblies, transmission assemblies, resistance assemblies and driving parts; wherein the stay cord assemblies comprise a stay cord, a first fixed pulley, a movable pulley block and a second fixed pulley block; the movable pulley block comprises a left movable pulley and a right movable pulley; the second fixed pulley block comprises a second left fixed pulley and a second right fixed pulley; a rotation direction of the second fixed pulley block is perpendicular to a rotation direction of the first fixed pulley; after the stay cord bypasses the first fixed pulley, two ends of the stay cord bypass the left movable pulley and the right movable pulley respectively, then bypass the second left fixed pulley and the second right fixed pulley respectively, the two ends of the stay cord are respectively connected to one driving part after bypassing the second left fixed pulley and the second right fixed pulley; and two driving parts pulls the movable pulley block to rotate and slide through the stay cord, the first fixed pulley and the second fixed pulley;

a third fixed pulley is provided between the movable pulley block and the transmission assemblies, and the third fixed pulley is connected to the resistance assemblies through the transmission assemblies.

In an embodiment, the transmission assemblies comprise a main transmission belt, an auxiliary transmission belt and a drive pulley and a driven pulley that are provided parallel to each other; one end of the main transmission belt is fixedly connected to the drive pulley, an other end bypasses the third fixed pulley and is fixedly connected to the movable pulley block, and a transmission shaft of the driven pulley is connected with the drive pulley through the auxiliary transmission belt and is driven by the drive pulley.

In an embodiment, the resistance assemblies comprise a first magnetic part provided on an outer periphery of the driven pulley and a second magnetic part provided outside the first magnetic part; a space is provided between the first magnetic part and the second magnetic part, and the first magnetic part and the second magnetic part cooperate to generate magnetic resistance to limit a rotation speed of the driven pulley.

In an embodiment, the second magnetic part is arc-shaped, two ends of the second magnetic part are respectively a fixed end and a free end; the fixed end is fixed below the first magnetic part, and the free end swings close to or away from the first magnetic part.

In an embodiment, a resistance adjusting assemblies is further comprised; wherein the resistance adjusting assemblies comprise an adjusting knob, an adjusting tube and an adjusting plate; the adjusting plate is provided on the second magnetic part, the adjusting tube is movably provided on the adjusting plate, and drives the adjusting plate to move up and down; the adjusting plate is further connected with a reset spring; and the adjusting knob drives the second magnetic part to approach or move away from the first magnetic part through the adjusting tube, the adjusting plate and the reset spring.

In an embodiment, a fourth fixed pulley is provided between the driving part and the stay cord; the stay cord is connected to the driving part by bypassing the fourth fixed pulley, the fourth fixed pulley is provided with a rotating part, and the rotating part rotates to drive the driving part to rotate.

The present disclosure is also intended to provide a rowing machine, comprising the resistance pulley structure and a seat main frame; wherein the resistance pulley structure comprises symmetrical stay cord assemblies, transmission assemblies, resistance assemblies and driving parts;

the driving parts are a paddle group comprising two paddles, the two paddles are respectively provided on both sides of the seat main frame, and bottom ends of the two paddles are universally connected to the seat main frame;

the stay cord assemblies comprise a stay cord, a first fixed pulley, a movable pulley block and a second fixed pulley block; the second fixed pulley block is provided above the first fixed pulley, a rotation direction of the second fixed pulley block is perpendicular to a rotation direction of the first fixed pulley; the movable pulley block comprises a left movable pulley and a right movable pulley, the second fixed pulley block comprises a second left fixed pulley and a second right fixed pulley; after the stay cord bypasses the first fixed pulley, two ends of the stay cord extend backwards symmetrically, and bypass the left movable pulley and the right movable pulley respectively, then the two ends are folded and extend forwards to bypass the second left fixed pulley and the second right fixed pulley respectively; the two ends of the stay cord respectively bypass the second left fixed pulley and the second right fixed pulley, and are respectively connected to a top of one paddle or connected to the top of one paddle at a same time;

a third fixed pulley is provided between the movable pulley block and the transmission assemblies, and the third fixed pulley is connected to the resistance assemblies through the transmission assemblies.

In an embodiment, the two ends of the stay cord are respectively provided with a pull ring, and two pull rings are respectively connected to one paddle or connected to a same paddle at a same time.

The present disclosure is yet further intended to provide a rowing high-position pull-down integrated machine applied to the resistance pulley structure, such that it can be used as a rowing training machine and a high-position pull-down training machine. Space and purchase costs can be saved, and quick switch of two kinds of training between machines can be realized.

In order to achieve the above object, the solution adopted by the present disclosure is: a rowing high-position pull-down integrated machine comprising a base, a support beam, and the resistance pulley structure; wherein the resistance pulley structure comprises symmetrical stay cord assemblies, transmission assemblies, resistance assemblies and driving parts;

the base is provided with a first leg supported on a ground, the support beam is longitudinally connected to one side of the base at an angle, the support beam is provided with a second leg and a driving part at an end far away from the base, and the second leg is supported on the ground together with the first leg or lifted off the ground with the support beam relative to the base; the base and the support beam are respectively provided with a first seat part and a second seat part on one side of the angle, the first seat part and the second seat part are for people to sit or lean on;

the resistance assemblies are provided inside the base and provided at a back of the first seat part; the driving parts comprise a handle or two handles provided in parallel; the stay cord assemblies comprise a stay cord, a first fixed pulley, a movable pulley block and a second fixed pulley block; the first fixed pulley block, the movable pulley block and the second fixed pulley block are provided inside the support beam, the second fixed pulley block is provided above the first fixed pulley block, and a rotation direction of the second fixed pulley block is perpendicular to a rotation direction of the first fixed pulley; the movable pulley block comprises a left movable pulley and a right movable pulley, the second fixed pulley block comprises a second left fixed pulley and a second right fixed pulley; after the stay cord bypasses the first fixed pulley, two ends of the stay cord bypass the left movable pulley and the right movable pulley respectively, then bypass the second left fixed pulley and the second right fixed pulley respectively, the two ends of the stay cord are respectively connected to one handle respectively or connected to a same handle after bypassing the second left fixed pulley and the second right fixed pulley;

a third fixed pulley is provided between the movable pulley block and the transmission assemblies, and the third fixed pulley is connected to the resistance assemblies through the transmission assemblies.

In an embodiment, a swing adjusting mechanism is further comprised; wherein the base is provided with the swing adjusting mechanism on a side connected to the support beam, and the support beam is rotatably connected on the base by the swing adjusting mechanism, such that the support beam is made to perform swinging motion relative to the base, and the angle between the support beam and the base is adjusted by the swing adjusting mechanism.

After adopting the above solutions, the beneficial effects of the present disclosure are:

1. The double output cord structure of the stay cord transmission mechanism is realized by setting symmetrical stay cord assemblies. The stay cord assemblies include a plurality of sets of fixed pulleys and movable pulleys. After bypassing the fixed pulley and the movable pulley, the two ends of a single stay cord are respectively connected to two symmetrical driving parts. The two driving parts exert force at the same time to make the force uniform. In the present disclosure, a single cord is used to realize the setting of double-output cord, such that the tensile force of the mechanism is greatly enhanced, and the stability of the mechanism is also improved.
2. The combination of the stay cord and paddle of the rowing machine is replaceable. Both ends of the stay cord can be connected to one paddle at the same time or to one paddle respectively. When connecting to one paddle respectively, double-arm training can be met. When connecting to one same paddle, it meets single-arm training.
3. Not only a plurality of sets of fixed pulleys but also movable pulleys are installed in the stay cord assemblies. The movable pulley cooperates with the transmission belt of the transmission mechanism to realize the expansion and contraction of the stay cord. The transmission belt winding is used instead of the traditional stay cord winding, so that the stay cord is always in a straight state, avoiding the phenomenon of knotting due to the stay cord winding, which affects the use of equipment.
4. The rowing high-position pull-down integrated machine has two usage states. One is the high-position pull-down trainer. In this state, the support beam is lifted relative to the base to stand on the base, and the first leg of the base bears the weight of the whole integrated machine. At this time, the handle assembly and the second leg are at a high position, and the user can start to pull the handle assembly to do high-position pull-down training actions when sitting on the first seat part. The resistance mechanism provides resistance for the training. The other use state is the rowing training machine. In this state, the support beam is down, the second leg touches the ground, and the second leg and the first leg jointly support the weight of the whole integrated machine. At this time, the first seat part changes from the riding function to the backrest function, and the second seat part changes from the backrest function to the riding function. The two functions are converted, and then the driving part is at a low position. The user can start to pull the driving part to do the rowing training action when sitting on the second seat part, and the resistance assemblies also provides resistance for training. The present disclosure has a simple structure, and can realize the combination of the rowing training machine and the high-position pull-down training machine, and quickly switch between the high-position pull-down training machine and the rowing training machine, saving occupying space and purchase costs. Moreover, the structure of the present disclosure is stable, whether it is in the state of the high-position pull-down training machine or the rowing training machine, high safety can be guaranteed, and better equipment selection for national fitness can be provided.

REFERENCE NUMERALS

1, stay cord assemblies; 11, stay cord; 12, first fixed pulley; 13, movable pulley block; 131, left movable pulley; 132, right movable pulley; 14, second fixed pulley block; 141, second left fixed pulley; 142, second right fixed pulley; 15, third fixed pulley; 16, fourth fixed pulley; 161, fourth left fixed pulley; 162, fourth right fixed pulley;

2, transmission assemblies; 21, main transmission belt; 22, auxiliary transmission belt; 23, drive pulley; 24, driven pulley; 241, transmission shaft; 25, pressing pulley; 26, tension spring;

3, resistance assemblies; 31, first magnetic part; 32, second magnetic part;

4, resistance adjusting assemblies; 41 adjusting knob; 42, reset spring; 43, adjusting plate; 44, through groove; 45, fixed plate; 46, through hole; 47, outer tube; 48, inner tube;

5, handle; 6, rotating part; 7, mounting block; 8, locking part;

100, seat main frame; 101, sliding seat; 102, pedal set; 103, rowing set; 104, pull ring; 105, paddle;

200, base; 201, first leg; 202, front leg; 203, rear leg; 204, first seat part; 205, second seat part; 300, support beam; 301, second leg; 302, pedal.

DESCRIPTION OF EMBODIMENTS

The present disclosure will be described in detail below in conjunction with the accompanying drawings and specific embodiments.

Embodiment 1

Figure 1:
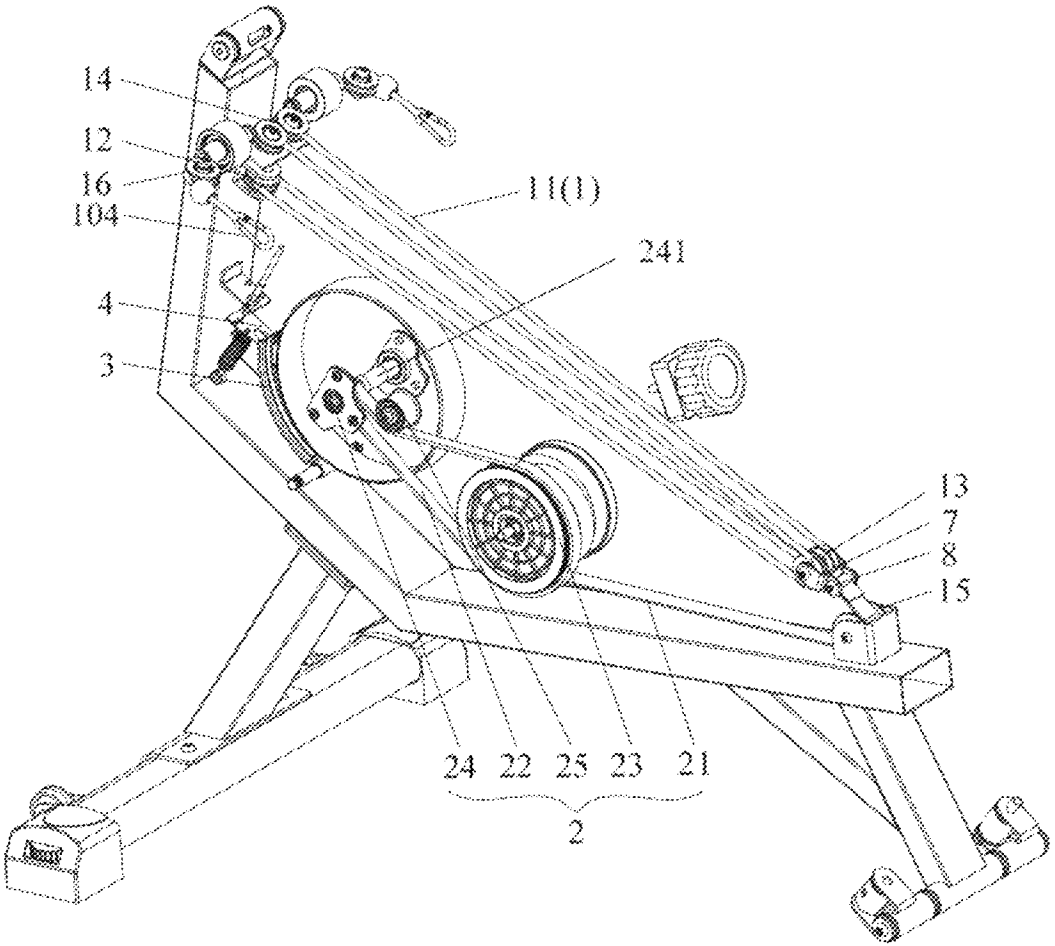
FIG. 1 is a schematic diagram of an assembly structure of a rope resistance transmission mechanism according to an embodiment of the present disclosure.
Figure 2:
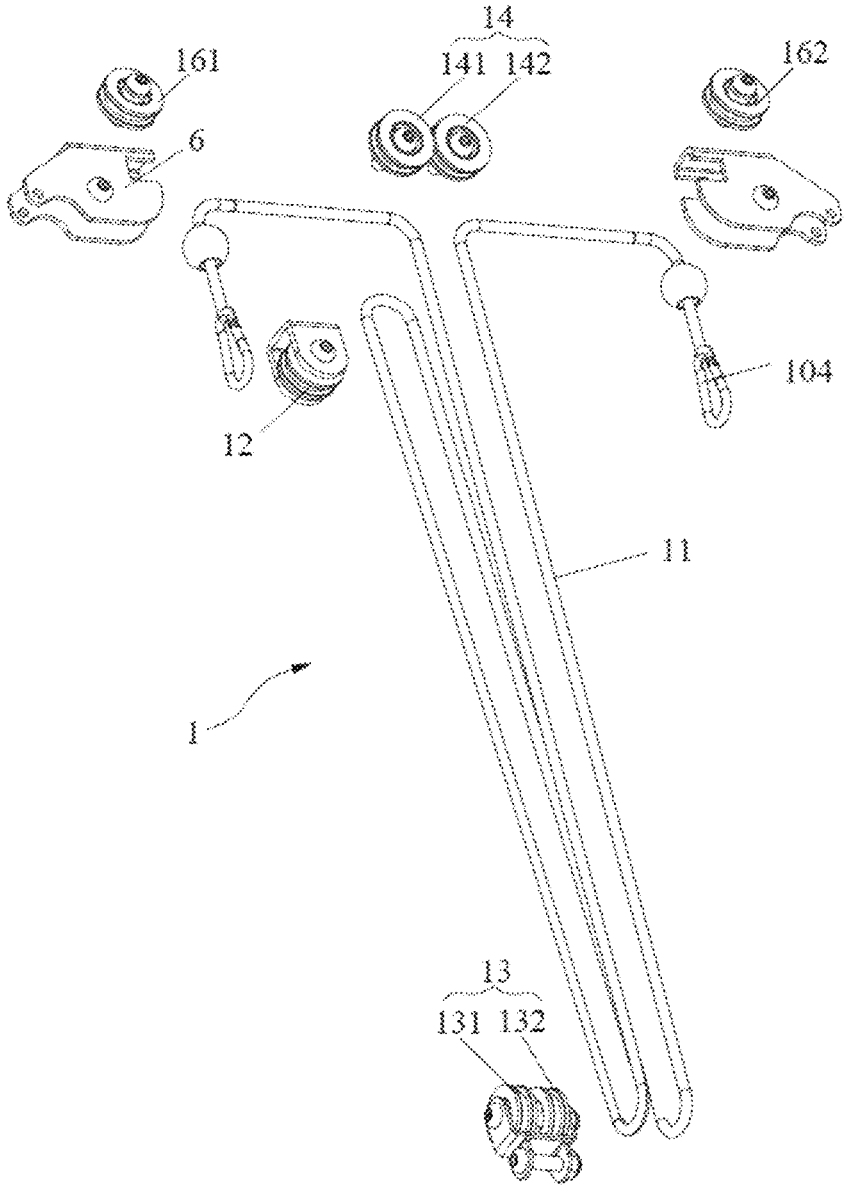
FIG. 2 is a schematic diagram of an exploded structure of stay cord assemblies according to an embodiment of the present disclosure.
Figure 3:
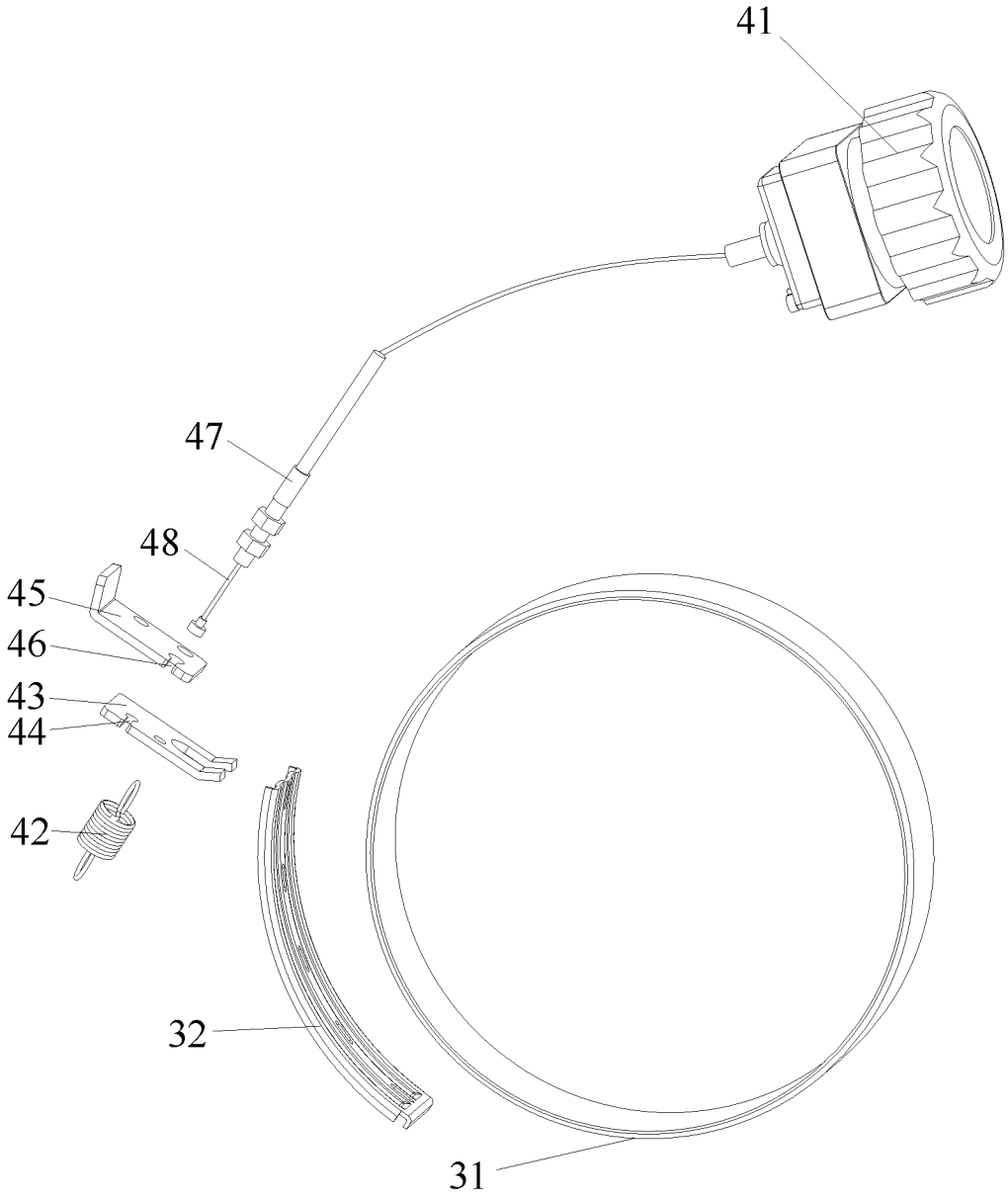
FIG. 3 is a schematic diagram of an exploded structure of resistance assemblies and a resistance adjusting assemblies according to an embodiment of the present disclosure.

The present disclosure provides a resistance pulley structure, as shown in FIGS. 1 to 3, which includes symmetrical stay cord assemblies 1, transmission assemblies 2, resistance assemblies 3, driving parts and resistance adjusting assemblies 4.

Figure 7:
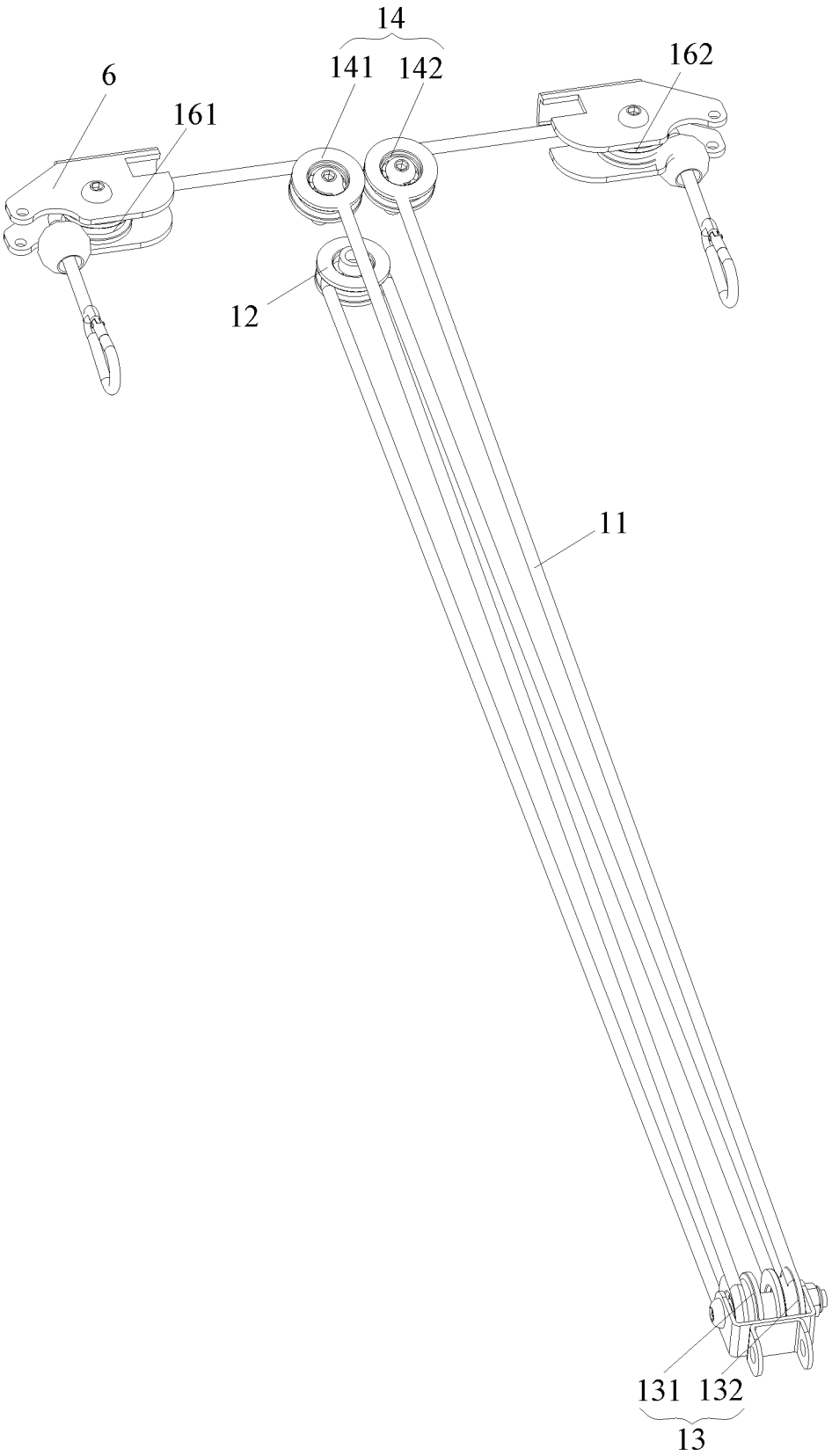
FIG. 7 is a schematic diagram of an assembly structure of the stay cord assemblies according to an embodiment of the present disclosure.

As shown in FIGS. 2 and 7, the stay cord assemblies 1 may include a stay cord 11, a first fixed pulley 12, a movable pulley block 13 and a second fixed pulley block 14. The second fixed pulley block 14 rotates perpendicularly to the rotation direction of the first fixed pulley 12, the second fixed pulley block 14 rotates in the same direction as the first fixed pulley 12. The stay cord 11 may be connected to the driving part by bypassing the first fixed pulley 12, the movable pulley block 13, and the second fixed pulley block 14 in turn.

Specifically, the movable pulley block 13 may include a left movable pulley 131 and a right movable pulley 132, and the second fixed pulley block 14 may include a second left fixed pulley 141 and a second right fixed pulley 142. After the stay cord 11 bypassed the first fixed pulley 12, its two ends bypass the left movable pulley 131 and the right movable pulley 132 respectively, and then after bypassing the left movable pulley 131 and the right movable pulley 132 respectively, the two ends of the stay cord 11 bypass respectively the second left fixed pulley 141 and the second right fixed pulley 142 provided above the first fixed pulley 12. The two ends of the stay cord 11 may be respectively connected to a driving part after bypassing the second fixed pulley block 14 (specifically, it can be a handle 5). As can be seen from the above, the two handles 5 pull the movable pulley block 13 to rotate and slide through the stay cord 11, the first fixed pulley block 12 and the second fixed pulley block 14.

As shown in FIGS. 2 and 7, in order to make the angle of the handle 5 adjustable and adapt to various needs, in the present disclosure, a fourth fixed pulley 16 can be provided between the handle 5 and the stay cord 11, and the fourth fixed pulley 16 includes a fourth left fixed pulley 161 and a fourth right fixed pulley 162. After the two ends of stay cord 11 bypass left movable pulley 131 and right movable pulley 132 respectively, then bypass the second left fixed pulley 141, the second right fixed pulley 142, the fourth left fixed pulley 161, and the fourth right fixed pulley 162, and may be connected to the handles 5 on both sides. The fourth fixed pulley 16 may be provided with a rotating part 6, and the fourth fixed pulley 16 adjusts the angle of the handle 5 through the rotating parts 6.

A third fixed pulley 15 may be provided between the movable pulley block 13 and the transmission assemblies 2, and the third fixed pulley 15 may be connected to the resistance assemblies 3 through the transmission assemblies 2.

As shown in FIG. 1, the transmission assemblies 2 may include a main transmission belt 21, an auxiliary transmission belt 22, a drive pulley 23 and a driven pulley 24 that are provided parallel to each other. The horizontal position of the drive pulley 23 may be slightly lower than that of the driven pulley 24. One end of the main transmission belt 21 may be fixedly connected with the drive pulley 23, and the other end may be fixedly connected with the movable pulley block 13 by bypassing the third fixed pulley 15. Wherein the connection mode of the movable pulley block 13 and the main transmission belt 21 is: the movable pulley block 13 is provided with a U-shaped mounting block 7, the left movable pulley 131 and the right movable pulley 132 are placed in the U-shaped opening of the mounting block 7, the two sides of the U-shaped opening of the mounting block 7 are connected with the two ends of the axle of the movable pulley block 13, and the bottom of the outer side of the mounting block 7 is fixed with the main transmission belt 21 by a locking part 8, so the movable pulley block 13 slides and drives the drive pulley 23 to rotate through the main transmission belt 21. The drive pulley 23 is connected with the driven pulley 24 by the auxiliary transmission belt 22, and the drive pulley 23 rotates and drives the driven pulley 24 to rotate through the auxiliary transmission belt 22.

In order to prevent the auxiliary transmission belt 22 from loosening during the transmission process, a pressing pulley 25 may be added between the transmission shaft of the driven pulley 24 and the drive pulley 23 in the present disclosure. The vertical position and the horizontal position of the pressing pulley 25 may be all located between the transmission shaft of the drive pulley 24 and the drive pulley 23, such that the pressing wheel 25 can press the auxiliary transmission belt 22 downward from the top of the auxiliary transmission belt 22, so that the auxiliary transmission belt 22 is tightly attached to the transmission shaft of the driven pulley 24, and the contact area between the auxiliary transmission belt 22 and the transmission shaft of the driven wheel 24 can be simultaneously increased, the friction can be increased, and the auxiliary transmission belt 22 can be effectively prevented from loosening.

The working process of the cord resistance transmission mechanism may be as follows:

Two handles 5 are pulled by external force, and the two handles 5 drive the movable pulley block 13 to slide through the stay cord 11, the first fixed pulley 12, and the second fixed pulley block 14; the movable pulley block 13 slides and drives the drive pulley 23 to rotate through the main transmission belt 21, and the drive pulley 23 rotates and drives the driven pulley 24 to rotate through the auxiliary transmission belt 22; and the resistance assemblies 3 on the driven pulley 24 provides magnetic resistance for the mechanism.

The resistance assemblies 3 of the present disclosure can be of various types, such as the resistance of the resistance assemblies 3 can originate from the pulling force of the coil spring, the elastic force of the elastic rope, etc., it is not limited in the present disclosure. As shown in FIG. 3, the resistance assemblies 3 can also be the magnetic resistance assemblies (referred to as the magnetic resistance mechanism) provided in this embodiment. The magnetic resistance mechanism may include a first magnetic part 31 and a second magnetic part 32. The first magnetic part 31 may be provided on the outer periphery of the driven pulley 24, and the second magnetic part 32 may be provided on the outside of the first magnetic part 31, a space is provided between the first magnetic part 31 and the second magnetic part 32, and the space between the first magnetic part 31 and the second magnetic part 32 determines the magnitude of the magnetic force. The first magnetic part 31 and the second magnetic part 32 cooperate to generate magnetic resistance to limit the rotational speed of the driven pulley 24. In the embodiment, the second magnetic part 32 may be arc-shaped, and its radian is the same as that of the first magnetic part 31. In addition, the two ends of the second magnetic part 32 may be respectively a free end and a fixed end. The fixed end may be fixed below the first magnetic part 31, the free end swings to approach or move away from the first magnetic part 31, thereby increasing or decreasing the magnetic resistance.

As shown in FIG. 3, the resistance of the resistance assemblies 3 can be adjusted through the resistance adjusting assemblies. The resistance adjusting assemblies in the present disclosure may be the resistance adjusting assemblies 4. The resistance adjusting assemblies 4 may include an adjusting knob 41, a fixed plate 45, an adjusting plate 43, an adjusting tube, and a reset spring 42. Among them, the adjusting tube includes an outer tube 47 and an inner tube 48, and the inner tube 48 is movably provided inside the outer tube 47. The adjusting plate 43 may be provided on the second magnetic part 32 and may be connected with the free end of the second magnetic part 32. The fixed plate 45 may be provided above the adjusting plate 43, and the adjusting plate 43 may be provided with a through groove 44, and the fixed plate 45 may be provided with a through hole 46 at a position corresponding to the through groove 44. The outer tube 47 may be fixed in the through hole 46 of the fixed plate 45, the upper end of the inner tube 48 may be connected with the adjusting knob 41, and the lower end passes through the outer tube 47 and the through groove 44 on the adjusting plate 43. Importantly, the lower end of the adjusting tube may be provided with a T-shaped end cap, the T-shaped end cap abuts against the lower end surface of the adjusting plate 43. The adjusting plate 43 may be also connected with a reset spring 42. When the adjusting knob 41 is unscrewed or tightened, through the adjusting tube, the adjusting plate 43 and the reset spring 42, the second magnetic part 32 may be driven to approach or move away from the first magnetic part 31, so as to achieve fine adjustment of the magnitude of the magnetic resistance.

The working principle of the resistance adjusting assemblies 4 is:

When the adjusting knob 41 is tightened, the inner tube 48 moves upward, the T-shaped end cap of the inner tube 48 abuts against the bottom of the adjusting plate 43 and drives the adjusting plate 43 to move upward. The adjusting plate 43 drives the second magnetic part 32 to approach the first magnetic part 31, the space between the first magnetic part 31 and the second magnetic part 32 is reduced, and the magnetism is increased. At this time, the transmission speed of the transmission assemblies 2 is reduced to increase the resistance of the handle 5. At this time, the reset spring 42 is in a stretched state;

When the adjusting knob 41 is unscrewed, the inner tube 48 moves downward, at this time, the T-shaped end cap of the inner tube 48 no longer abuts the adjusting plate 43, and the reset spring 42 shrinks and drives the adjusting plate 43 to move downward to reset. The adjusting plate 43 drives the second magnetic part 32 to move away from the first magnetic part 31, the space between the first magnetic part 31 and the second magnetic part 32 increases, and the magnetism decreases. At this time, the transmission speed of the transmission assemblies 2 increases to reduce the resistance of the handle 5.

Figure 4:
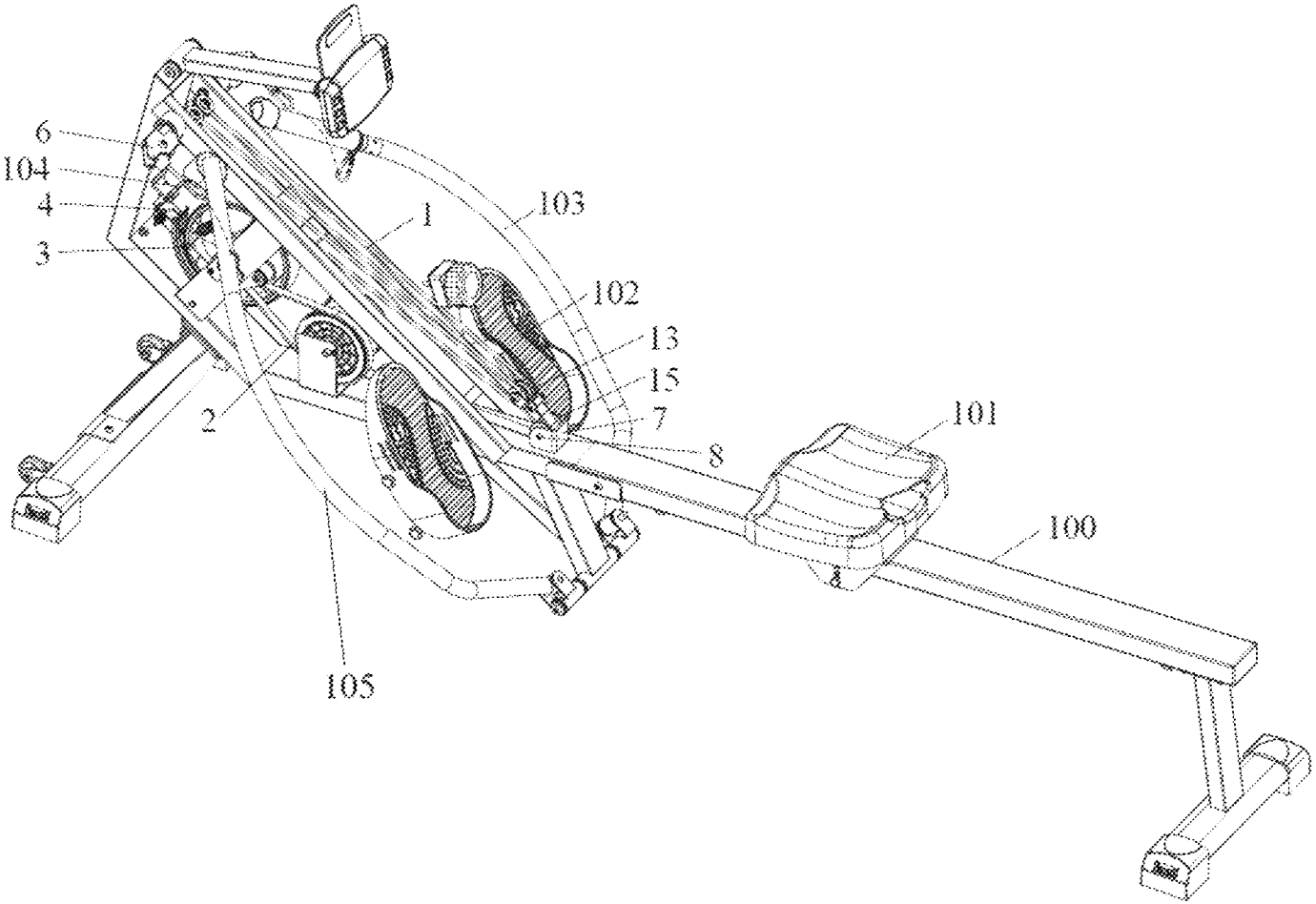
FIG. 4 is a three-dimensional structural schematic diagram of a rowing machine according to an embodiment of the present disclosure.
Figure 5:
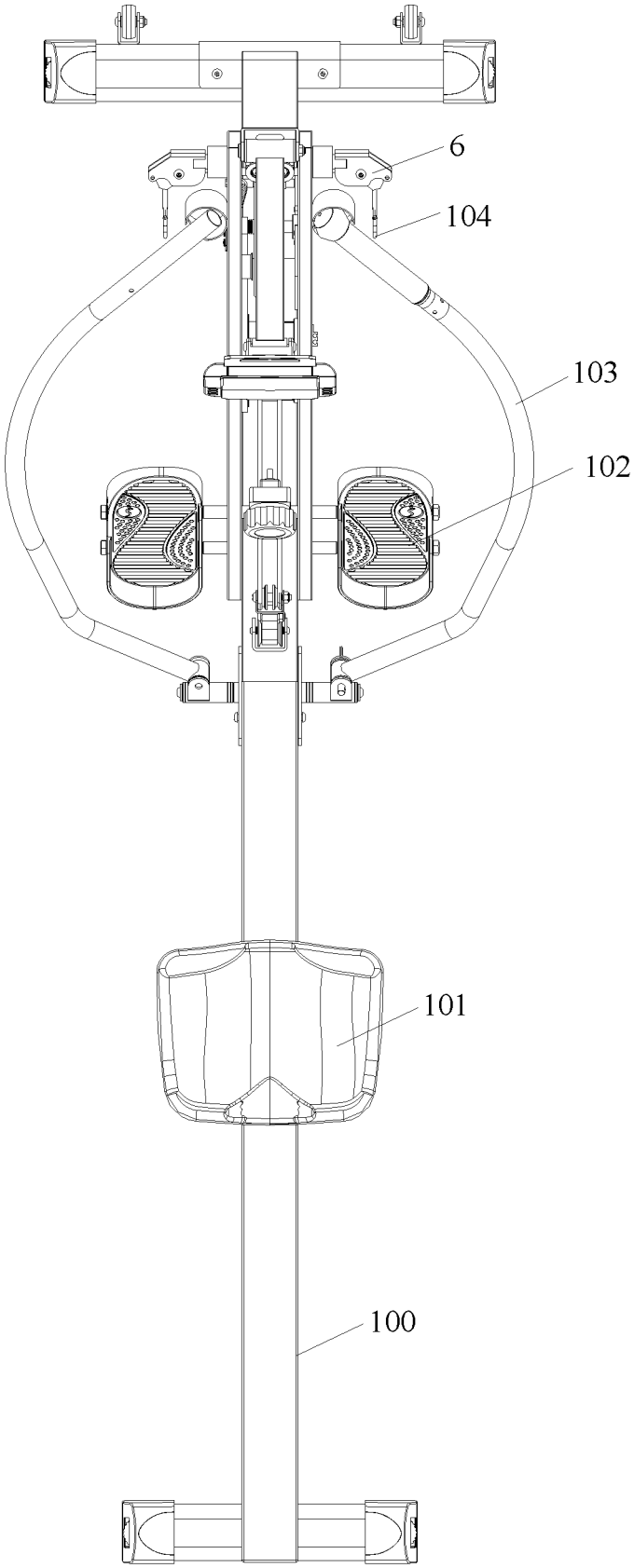
FIG. 5 is a top view structure diagram of a rowing machine according to an embodiment of the present disclosure.
Figure 6:
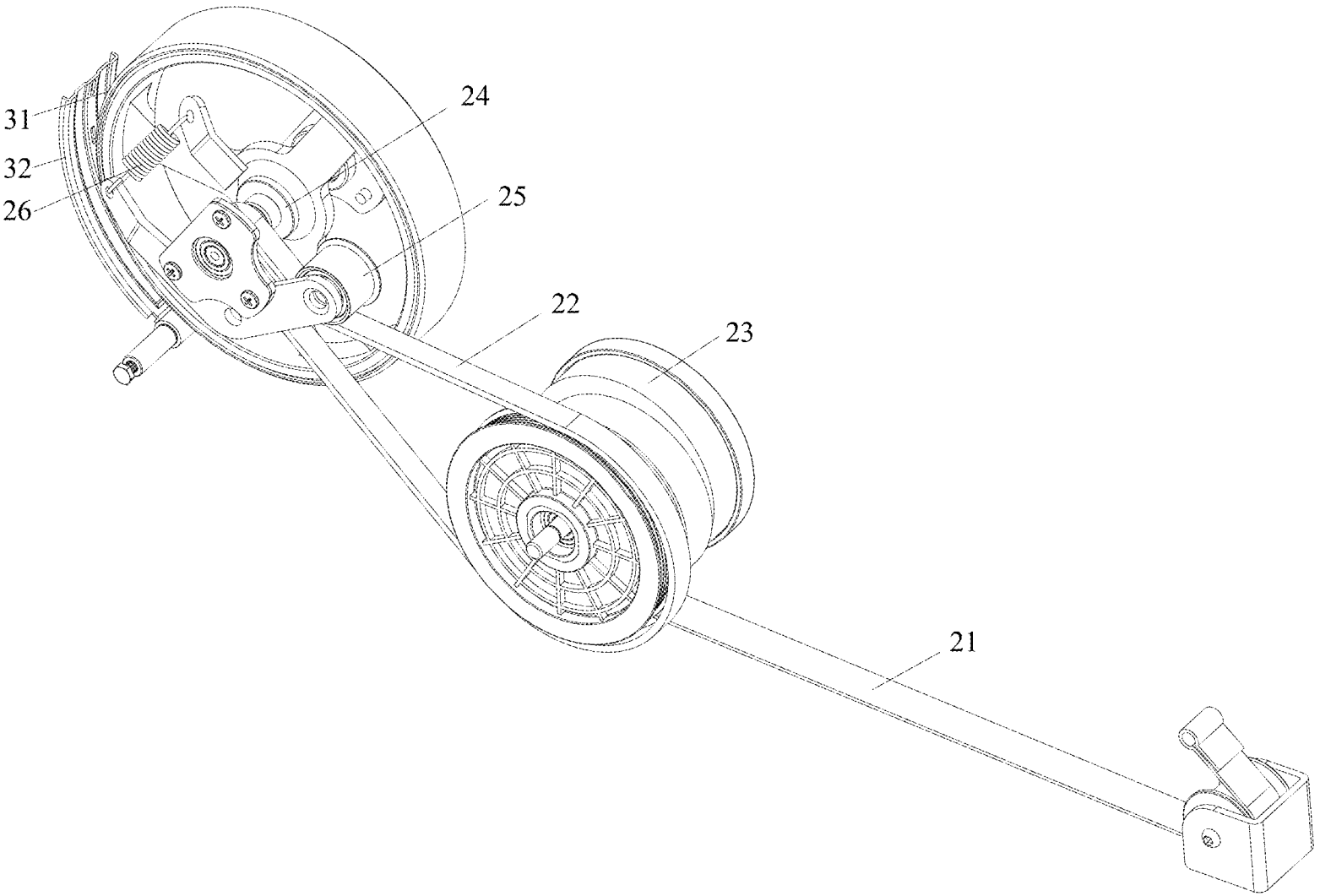
FIG. 6 is a schematic diagram of an assembly structure of the resistance assemblies and the transmission assemblies according to an embodiment of the present disclosure.

The present disclosure also provides a rowing machine using the above-mentioned resistance pulley mechanism, as shown in FIGS. 4 to 6, comprising a resistance pulley structure, a seat main frame 100, a slide seat 101, a pedal set 102 and a resistance adjusting assemblies 4. The resistance pulley structure may include symmetrical stay cord assemblies 1, transmission assemblies 2, resistance assemblies 3 and driving parts;

Wherein, the sliding seat 101 may be provided on the seat main frame 100, and can move back and forth along the seat main frame 100. The pedal set 102 may include two paddles respectively provided on both sides of the seat main frame 100. The driving parts are rowing set 103 with two paddles respectively provided on both sides of the seat main frame 100. The bottom end of the paddle is universally connected with the seat main frame 1, and the top end of the paddle is connected with the stay cord assembly 1. The rowing set 103 realizes tension training by sequentially connecting the pull cord assembly 1, the transmission assembly 2 and the resistance assembly 3. In the present disclosure, the transmission assembly 2, the resistance assembly 3 and the resistance adjusting assembly 4 are all provided below the stay cord assembly 1, so that the entire rowing machine has a triangular structure, compact structure, and saves space to the greatest extent.

As shown in FIGS. 2, 4 and 7, the stay cord assemblies 1 comprises a stay cord 11, a first fixed pulley 12, a movable pulley block 13 and a second fixed pulley block 14. The second fixed pulley block 14 rotates in a direction perpendicular to the rotation direction of the first fixed pulley 12. The second fixed pulley block 14 and the first fixed pulley 12 rotate in the same direction. The stay cord 11 may be connected to the driving part by bypassing the first fixed pulley 12, the movable pulley block 13, and the second fixed pulley block 14 in turn.

Specifically, the movable pulley block 13 may include a left movable pulley 131 and a right movable pulley 132. The second fixed pulley block 14 may include a second left fixed pulley 141 and a second right fixed pulley 142. After the stay cord 11 bypasses the first fixed pulley 12, its two ends extend symmetrically backward, and bypass the left movable pulley 131 and the right movable pulley 132 respectively. The two ends of the stay cord 11 bypass the left movable pulley 131 and the right movable pulley 132 respectively from bottom to top, then fold and extend forward to bypass the second left fixed pulley 141 and the second right fixed pulley 142 located above the first fixed pulley 12 respectively. After bypassing the second fixed pulley block 14, the two ends of the stay cord 11 extend to both sides respectively and may be respectively connected with a paddle. As can be seen from the above, the two paddles pull the movable pulley block 13 to rotate and slide through the stay cord 11, the first fixed pulley block 12 and the second fixed pulley block 14.

The combination of the stay cord 11 and the paddle in the present disclosure is replaceable. The two ends of the stay cord 11 may be respectively provided with a pull ring 104 configured to combine the stay cord 11 with the paddle. As shown in FIG. 4, the pull ring 104 can connect each end of the stay cord 11 to one paddle or both to the same paddle. When each is connected to one paddle, the resistance of the two paddles is the same, and the user can hold the paddle with both hands for double-arm workout when both are connected to one same paddle, the paddle has double resistance, and the user holds the paddle with one hand for a single-arm workout.

As shown in FIG. 2, FIG. 6 and FIG. 7, the present disclosure also provides a paddle with an adjustable angle, and the adjustment of the paddle angle can meet the training needs of different postures of the user. In the present disclosure, a fourth fixed pulley 16 may be provided between the paddle and the stay cord 11. The fourth fixed pulley 16 may include a left fourth fixed pulley 161 and a right fourth fixed pulley 162. After the two ends of the stay cord 11 bypass the left movable pulley 131 and the right movable pulley 132 respectively, then bypass the left fourth fixed pulley 161 and the right fourth fixed pulley 162, then is connected to the paddles on both sides. The fourth fixed pulley 16 may be provided with a rotating part 6, and the fourth fixed pulley 16 adjusts the angle of paddle through the rotating part 6.

As shown in FIG. 4, the transmission assemblies 2 and the stay cord assemblies 1 may be connected through a third fixed pulley 15, the third fixed pulley 15 may be fixed on the seat main frame 100, and may be provided between the sliding seat 101 and the transmission assemblies 2. As shown in FIG. 6, the transmission assemblies 2 includes a main transmission belt 21, an auxiliary transmission belt 22, and a drive pulley 23 and a driven pulley 24 provided parallel to each other. The horizontal position of the drive pulley 23 may be slightly lower than that of the driven pulley 24. The auxiliary transmission belt 22 may be respectively connected to the transmission shafts of the drive pulley 23 and the driven pulley 24, and the rotation of the drive pulley 23 drives the driven pulley 24 to rotate through the auxiliary transmission belt 22. One end of the main transmission belt 21 may be fixedly connected with the drive pulley 23, and can be rolled up or unfolded on the drive pulley 23, and the other end may be fixedly connected with the movable pulley 13 by bypassing the third fixed pulley 15. The movable pulley 13 slides to stretch the main transmission belt 21, thereby driving the drive pulley 23 to rotate. A tension spring 26 may be provided between the drive pulley 23 and the main seat frame 100, and the restoring elastic force of the tension spring 26 can make the drive pulley 23 reversely rotate. Wherein, the connection mode of movable pulley block 13 and main transmission belt 21 is: a U-shaped mounting block 7 is provided on movable pulley block 13, the left movable pulley 131 and the right movable pulley 132 are placed in the U-shaped opening of mounting block 7; both sides of the U-shaped opening of mounting block 7 are connected with the two ends of the wheel axle of the movable pulley block 13, and the bottom outside the mounting block 7 is fixed with the main transmission belt 21 by a locking part. Therefore, the movable pulley block 13 slides and drives the drive pulley 23 to rotate through the main transmission belt 21. The drive pulley 23 is connected with the driven pulley 24 by the auxiliary transmission belt 22, and the drive pulley 23 rotates and drives the driven pulley 24 to rotate through the auxiliary transmission belt 22.

The working process of the rowing machine may be as follows:

A state that each of the two pull rings 104 is respectively connected to a paddle: the user sits on the sliding seat 101, steps on the pedal set 102 with both feet, holds two rowing paddles, and then pushes the legs straight and leans back, taking advantage of the situation to pull the paddle backward; the stay cord 11 is pulled out backward to drive the movable pulley block 13 to slide forward. The movable pulley block 13 pulls out the main transmission belt 21 and drives the drive pulley 23 to rotate counterclockwise, and the drive pulley 23 drives the driven pulley 24 to rotate by the auxiliary transmission belt 22. The resistance assemblies 3 on the driven pulley 24 provides resistance. When the user relaxes the force, the drive pulley 23 can reversely rotate through the restoring elastic force of the tension spring 26, so that the main rotating belt may be retracted and driven by the drive pulley 23, to drive the movable pulley block 13 slide backward to reset, and the movable pulley block 13 is pulled by the stay cord 11 to guide the user to reset forward. When the user only wants to exercise the strength of a single arm, he can connect the two pull rings 104 to the handle on the same side, and the movement process of the mechanism is the same as above.

The resistance assemblies 3 of the rowing machine of the present disclosure also adopts the same resistance assemblies 3 and resistance adjusting assemblies 4 as above to control the resistance of paddle, which will not be repeated here.

Figure 8:
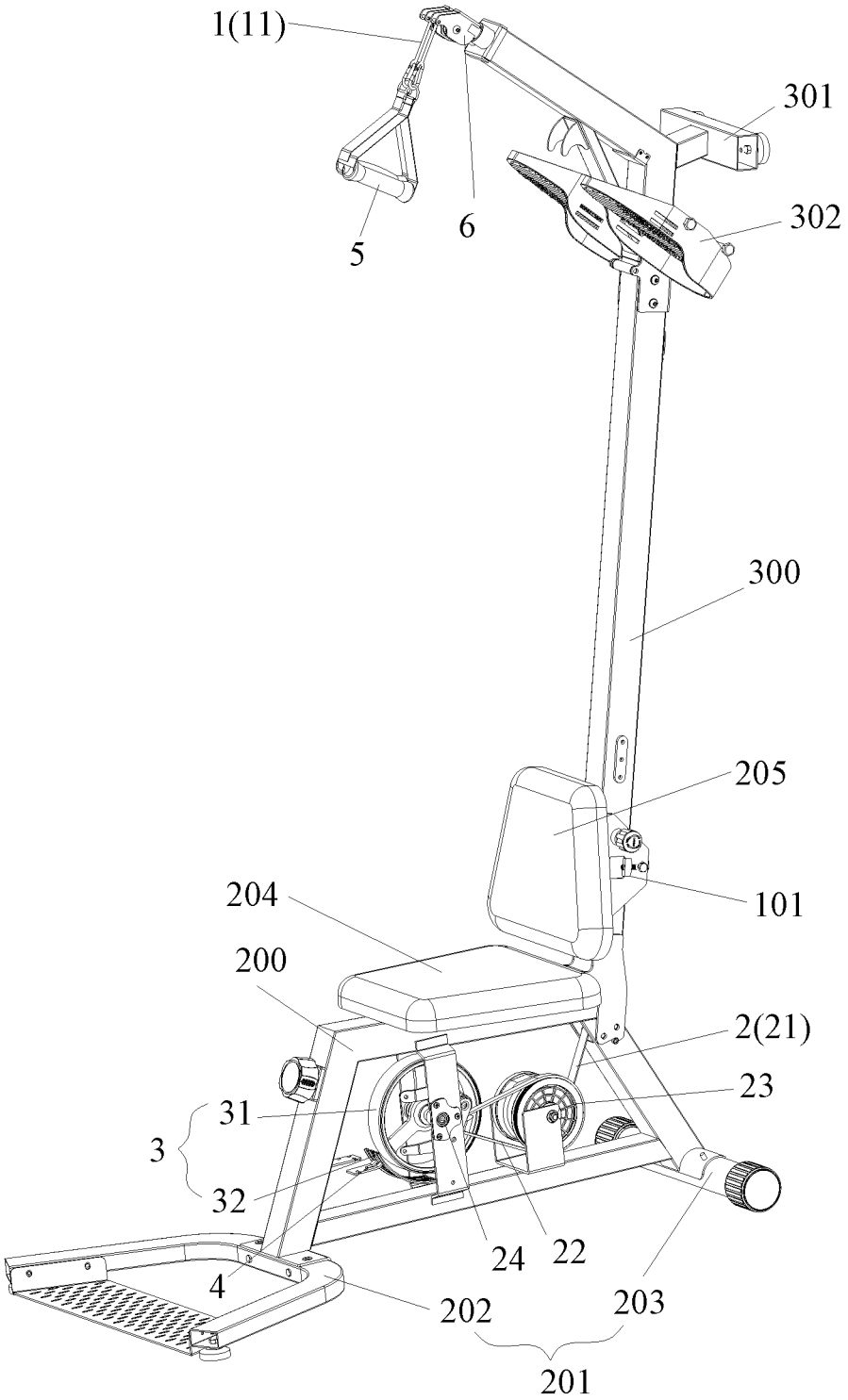
FIG. 8 is a structural schematic diagram of an integrated rowing high-position pull-down machine used as a high-position pull-down training machine according to an embodiment of the present disclosure.
Figure 9:
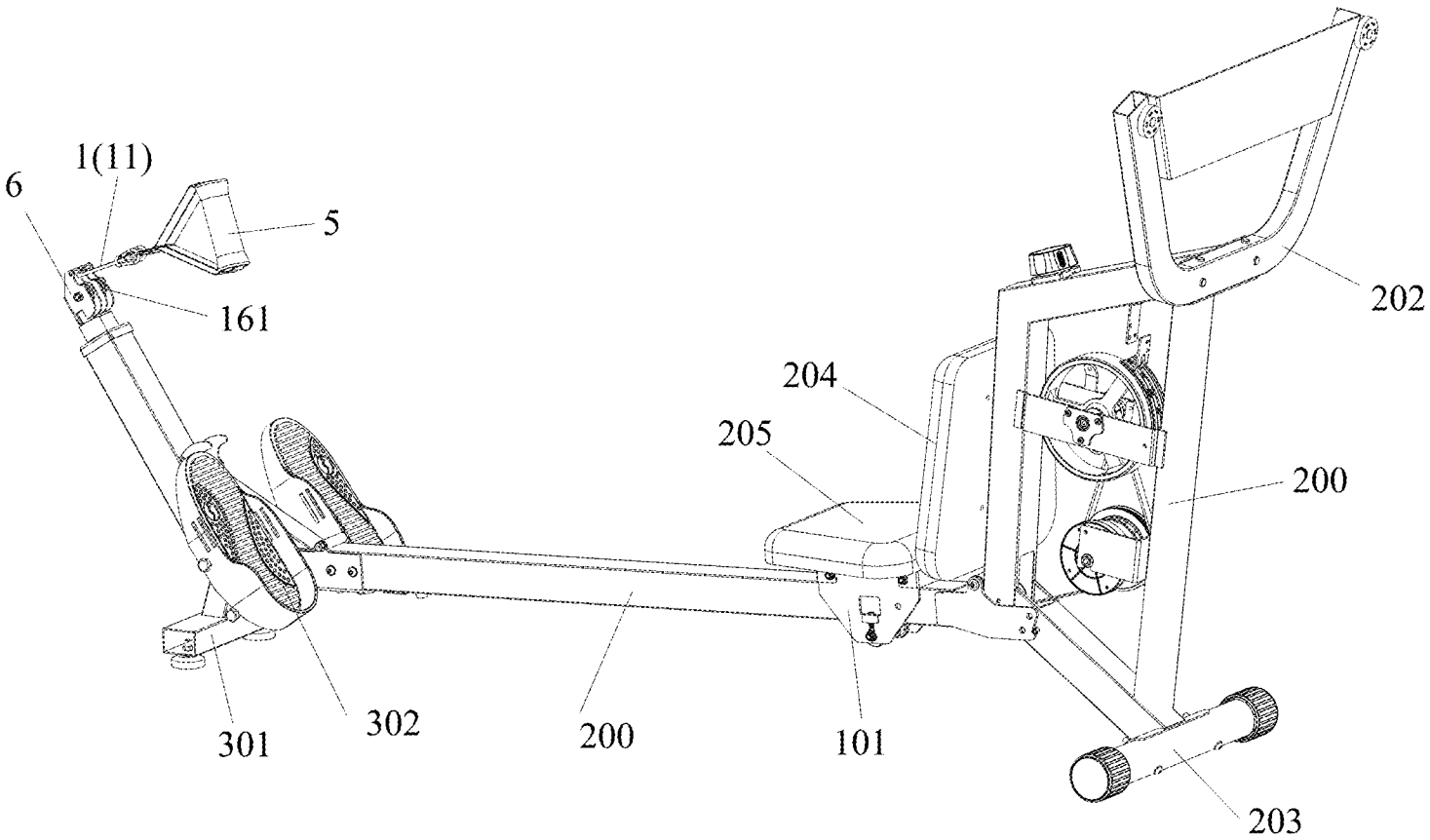
FIG. 9 is a structural schematic diagram of an integrated rowing high-position pull-down machine used as a rowing training machine according to an embodiment of the present disclosure.

The present disclosure also provides a high-position pull-down integrated (all-in-one) rowing machine. As shown in FIGS. 8 and 9, the rowing machine comprises a base 200, a support beam 300 and the resistance pulley assemblies 3 and the driving parts.

The base 200 may be a seat body formed by a plurality of frames and may be hollow inside. The bottom of the base 200 may be provided with a first leg 201. Specifically, the first leg 201 of the embodiment can be divided into a front leg 202 and a rear leg 203. Of course, the first leg 201 described in the present disclosure can also be integrated as a whole, and the function of the first leg 201 may be to support the all-in-one machine on the ground.

The support beam 300 may be longitudinally connected to one side of the base 200 at an angle. To be precise, one end of the support beam 300 is longitudinally connected to one side of the base 200, so the support beam 300 is provided with a second leg 301 and driving parts at the other end away from the base 200. The driving part may be connected to the resistance assemblies 3 through the transmission assemblies 2. The base 200 and the support beam 300 may be respectively provided with a first seat part 204 and a second seat part 205 on one side of the angle, and the first seat part 204 and the second seat part 205 are for people to sit or lean on. The preferred angle of the angle may be between 90°-180°.

As shown in FIG. 8, when the all-in-one machine of the present disclosure is used as a high-position pull-down training machine, the support beam 300 is lifted up, and the second leg 301 and the driving parts may be lifted to the top of the base 200 with the support beam 300 relative to the base 200. At this time, the first seat part 204 is used for riding, and the second seat part 205 is used for backrest, and the user can pull the driving part up and down to perform high-position pull-down action training.

As shown in FIG. 9, when the all-in-one machine of the present disclosure is used as a rowing training machine, the support beam 300 is laid down, and the support beam 300 may be provided horizontally, and the second leg 301 and the first leg 201 may be jointly supported on the ground, while the base 200 is tilted longitudinally relative to the support beam 300. At this time, the first seat part 204 is used for backrest, and the second seat part 205 is used for riding. The user can perform rowing training by pulling the driving parts back and forth. The support beam 300 in the embodiment may be further provided with a pedal 302 at the end away from the base 200, convenient for placing the feet straight during rowing training.

In the embodiment, the first seat part 204 may be a first seat cushion fixed on the base 200, and the first seat cushion does not need to move, so it is set in a fixed manner. Compared with the first seat cushion, the position of the second seat part 205 needs to be adjusted on the support beam 300. The second seat part 205 may be a second seat cushion, the support beam 300 may be provided with a sliding seat 101 sliding along the length direction of the support beam 300, and the sliding seat 101 is provided with the second seat cushion. In this way, the user can perform the rowing action of the hands while cooperating with the legs to perform the rolling and stretching action of the legs. Meanwhile, the support beam 300 may be provided with a limit mechanism, when there is no need for the legs to roll and stretch, the second seat cushion can be fixed on the support beam 300 by the limit mechanism after the second seat cushion slides.

A rowing high-position pull-down all-in-one machine of the present disclosure also adopts the same resistance assemblies 3 and resistance adjusting assemblies 4 as above to control the resistance of the driving parts, which will not be repeated here. According to the present disclosure, the resistance assemblies 3 and the resistance adjusting assemblies 4 may be provided inside the base 200, and the resistance assemblies 3 may be located on the back of the first seat part. The advantage of this arrangement is that the internal space of the base 200 can be fully utilized to place the resistance assemblies 3, such that space can be saved and the stability of the base 200 can be increased at the same time.

The rowing high-position pull-down all-in-one machine according to the present disclosure is shown in FIG. 7, the transmission assemblies 2 may be provided inside the support beam 300, such that transmission assemblies 2 can be hidden well, and the stay cord can be prevented from interface. One end of the main transmission belt 21 is fixedly connected to the drive pulley 23, and the other end is fixedly connected to the movable pulley block 13 (hidden inside the support beam 300) by bypassing the third fixed pulley 15 (hidden inside the support beam 300), to realize the transmission of resistance.

The driving part of the rowing high-position pull-down integrated machine of the present disclosure may include a handle 5 or two handles 5 provided in parallel, and the user can connect two stay cords 11 to one handle 5. At this time, the one handle 5 has the load of an entire resistance assemblies. Alternatively, the user can connect the two handles 5 through two stay cords 11 respectively, and at this time, the two handles 5 divide the load of the resistance assemblies 3 equally through the transmission assemblies 2. Whether one handle or two handles are adopted to adjust the weight is up to the user to choose according to their own training needs.

The two handles 5 also adjust the angle of the handles 5 through the rotating part 6, so that the pulling direction of the handles can be changed.

Embodiment 2

The difference between Embodiment 2 and Embodiment 1 is that the all-in-one rowing machine also includes a swing adjusting mechanism (not shown in the figures). The base 200 may be provided with a swing adjusting mechanism on the side connected to the support beam 300. The support beam 300 may be rotatably connected to the base 200 through the swing adjusting mechanism, so that the support beam 300 performs a swing movement relative to the base 200, and the angle between the support beam 300 and the base 200 may be adjusted through the swing adjusting mechanism. The advantage of the design of this structure is that the use of the rowing training machine and the high-position pull-down training machine does not need to be converted by lifting or lowering the support beam 300, but only needs to rotate the support seat through the swing adjusting mechanism, so that the support beam 300 swings relative to the base 200, and the angle of swing can be 90°-180°. When the angle of swing is 90°, the support beam 300 is longitudinally connected to the base 200, used as a high-position pull-down training machine. When the angle is 180°, the support beam 300 is laterally connected to the base 200, used as a rowing training machine. In this way, the conversion process between the rowing training machine and the high-position pull-down training machine is convenient, quick and labor-saving.

The directional terms such as up, down, left, right, front, back, ahead, rear, top, and bottom that are mentioned or may be mentioned in the specification may be defined relative to the structures shown in the figures. They are relative concepts, so they may change accordingly according to their actual location and usage status. Accordingly, these or other directional terms should not be construed as limiting terms.

The above descriptions are only preferred embodiments of the present disclosure, and are not limitations on the design of the present disclosure. All equivalent changes made according to the design key of the present disclosure all fall within the scope of protection of the present disclosure.

What is claimed is:

1. A resistance pulley structure, comprising a stay cord assembly, a transmission assembly, a resistance assembly and a paddle group comprising two paddles; wherein the stay cord assembly comprises a stay cord, a first fixed pulley, a movable pulley block and a second fixed pulley block; the movable pulley block comprises a left movable pulley and a right movable pulley; the second fixed pulley block comprises a second left fixed pulley and a second right fixed pulley; a rotation direction of the second fixed pulley block is parallel to a rotation direction of the first fixed pulley; after the stay cord bypasses the first fixed pulley, two ends of the stay cord bypass the left movable pulley and the right movable pulley respectively, then bypass the second left fixed pulley and the second right fixed pulley respectively, the two ends of the stay cord are respectively connected to one of the two paddles after bypassing the second left fixed pulley and the second right fixed pulley; and the two paddles are pulled to make the movable pulley block to rotate and slide, through the stay cord, the first fixed pulley and the second fixed pulley block;

a third fixed pulley is provided between the movable pulley block and the transmission assembly, and the third fixed pulley is connected to the resistance assembly through the transmission assembly.

2. The resistance pulley structure as claimed in claim 1, wherein: the resistance assembly comprises a first magnetic part provided on an outer periphery of the driven pulley and a second magnetic part provided outside the first magnetic part; a space is provided between the first magnetic part and the second magnetic part, and the first magnetic part and the second magnetic part cooperate to generate magnetic resistance to limit a rotation speed of the driven pulley.

3. The resistance pulley structure as claimed in claim 2, wherein: the second magnetic part is arc-shaped, two ends of the second magnetic part are respectively a fixed end and a free end; the fixed end is fixed below the first magnetic part, and the free end swings towards or away from the first magnetic part.

4. The resistance pulley structure as claimed in claim 2, further comprising a resistance adjusting assembly; wherein the resistance adjusting assembly comprises an adjusting knob, an adjusting tube and an adjusting plate; the adjusting plate is provided on the second magnetic part, the adjusting tube is movably provided on the adjusting plate, and drives the adjusting plate to move up and down; the adjusting plate is further connected with a reset spring; and the adjusting knob drives the second magnetic part to approach or move away from the first magnetic part, through the adjusting tube, the adjusting plate and the reset spring.

5. A rowing machine, comprising the resistance pulley structure according to claim 1 and a seat main frame; wherein the two paddles are respectively provided on both sides of the seat main frame, and bottom ends of the two paddles are each connected to the seat main frame;

the second fixed pulley block is provided above the first fixed pulley; after the stay cord bypasses the first fixed pulley, two ends of the stay cord extend towards symmetrically and bypass the left movable pulley and the right movable pulley respectively, then the two ends are folded and extend towards and bypass the second left fixed pulley and the second right fixed pulley respectively; the two ends of the stay cord respectively bypass the second left fixed pulley and the second right fixed pulley, and are respectively or both connected to a top of one of the two paddles.

6. The resistance pulley structure as claimed in claim 5, wherein: the two ends of the stay cord are respectively provided with a pull ring, and two pull rings are respectively or both connected to one of the two paddles.

7. The resistance pulley structure as claimed in claim 1, wherein: the transmission assembly comprises a main transmission belt, an auxiliary transmission belt, a drive pulley and a driven pulley provided parallel to the drive pulley; one end of the main transmission belt is fixedly connected to the drive pulley, another end bypasses the third fixed pulley and is fixedly connected to the movable pulley block, and a transmission shaft of the driven pulley is connected with the drive pulley through the auxiliary transmission belt and is driven by the drive pulley.

8. The resistance pulley structure as claimed in claim 1, wherein: a fourth fixed pulley is provided between the paddle group and the stay cord; the stay cord is connected to the paddle group by bypassing the fourth fixed pulley, the fourth fixed pulley is provided with a rotating part, and the rotating part is capable of being rotated to drive the two paddles to rotate.

* * * * *